US006347435B1

(12) United States Patent
Davignon et al.

(10) Patent No.: US 6,347,435 B1
(45) Date of Patent: Feb. 19, 2002

(54) RIVET TIE FOR COUPLING TOGETHER TWO OR MORE OBJECTS

(75) Inventors: Paul A. Davignon, Uxbridge; James C. Benoit, Needham, both of MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/513,801

(22) Filed: Feb. 25, 2000

(51) Int. Cl.[7] ..... A44B 21/00; B65D 63/00; F16L 3/08

(52) U.S. Cl. ..... 24/16 PB; 24/17 AP; 411/338; 411/340

(58) Field of Search ..... 24/16 PB, 17 AP, 24/30.5 P; 248/74.3; 411/338, 339, 340, 344, 345

(56) References Cited

U.S. PATENT DOCUMENTS

| | | | | | |
|---|---|---|---|---|---|
| 2,560,110 | A | * | 7/1951 | Horn | 411/338 |
| 3,525,123 | A | * | 8/1970 | Hidassy | 24/16 PB |
| 3,556,575 | A | * | 1/1971 | Farkas | 24/16 PB |
| 3,766,608 | A | | 10/1973 | Fay | |
| 3,924,298 | A | * | 12/1975 | Merser | 24/16 PB |
| 3,938,587 | A | * | 2/1976 | Vian | 411/339 |
| 4,263,697 | A | * | 4/1981 | Speedie | 24/16 PB |
| 4,347,648 | A | | 9/1982 | Dekkers | |
| 4,501,049 | A | * | 2/1985 | Adamson | 24/17 AP |
| 4,617,702 | A | * | 10/1986 | Diederich, Jr. | 24/17 AP |
| 4,754,529 | A | | 7/1988 | Paradis | |
| 4,865,501 | A | * | 9/1989 | Ferris | 411/340 |
| 5,136,758 | A | * | 8/1992 | Wilcox et al. | 24/16 PB |
| 5,337,983 | A | * | 8/1994 | Mailey | 403/405.1 |
| 5,402,971 | A | * | 4/1995 | Bower | 24/16 PB |

FOREIGN PATENT DOCUMENTS

| | | | | |
|---|---|---|---|---|
| DE | 2458943 | * | 12/1975 | 24/16 PB |

* cited by examiner

*Primary Examiner*—Victor N. Sakran
(74) *Attorney, Agent, or Firm*—Kriegsman & Kriegsman

(57) ABSTRACT

A rivet tie for coupling together two or more objects. In one embodiment, the tie includes a cable tie shank and a pawl nut which are integrally connected together by a break-away attachment member of reduced strength. The cable tie shank includes a tail having a first end, a second end, a top surface, a plurality of ratchet teeth formed on the top surface and an enlarged button end integrally formed onto the second end. The pawl nut can be separated from the cable tie shank and includes a top surface, a bottom surface, an elongated central opening and a flexible pawl disposed to project into the elongated central opening. In use, two or more objects are disposed on the tail of the cable tie shank. The pawl nut is then slidably mounted onto the tail so as to effectively sandwich the objects between the enlarged button end and the pawl nut, the pawl sequentially engaging the plurality of ratchet teeth on the strap to secure the coupling of the objects together. In another embodiment, the tie further includes a shroud formed onto the top surface of the pawl nut over the elongated central opening, the shroud serving to prevent tampering of the flexible pawl when the tail is inserted into and through the pawl nut.

13 Claims, 5 Drawing Sheets

RIVET TIE FOR COUPLING TOGETHER TWO OR MORE OBJECTS

BACKGROUND OF THE INVENTION

The present invention relates generally to ties for coupling together two or more objects.

Ties are well known and are widely used in the art for bundling together two or more objects.

Cable ties are one type of tie which is well known and widely used in the art to bundle together a plurality of objects, such as wires.

One type of cable tie which is well known and widely used in the art comprises a serrated strap that is fitted to an apertured head containing an internal pawl or locking tang that engages the serrations of the strap.

In U.S. Pat. No. 4,754,529 to J. R. Paradis, which is incorporated herein by reference, there is disclosed a bundling of objects using a harnessing device with a locking head and a strap with teeth that are controlled by stretching. The locking head contains a pawl or tang that engages the teeth of the strap by wedging. One or more wedging teeth are desirably located on the locking tang as well. A further tooth to promote locking is desirably included in the locking head. The strap is advantageously molded of stretch reorientable material which is subsequently stretched to control the profile of the teeth which are engaged by the locking tang and head. The teeth are spaced on the strap to permit use of the teeth near the head for the harnessing of small bundles. The pawl is provided with specified pivot points for both the insertion and loading of the strap in the head.

Another type of cable tie which is well known and widely used in the art comprises an apertured strap fitted to a buckle-like head, with a tongue that enters the apertures of the strap.

In U.S. Pat. No. 3,766,608 to R. B. Fay, which is incorporated herein by reference, there is disclosed a tie formed by a locking head and an attached ladder strap. The head contains a longitudinal guide channel for receiving the strap, after encirclement of items to be bundled, and an internal locking tang. The latter is deflected with respect to relatively narrow auxiliary channels on opposite sides of the guide channel. One of the auxiliary channels receives the locking tang during the bundling of the items; the other auxiliary channel contains a stop against which the locking tang becomes abutted in planar engagement by the reverse thrust of the harnessed items.

In U.S. Pat. No. 4,347,648 to L. P. Dekkers, which is incorporated herein by reference, there is disclosed a tie formed by a locking head and an attached ladder strap. Tile head contains a locking tang and a guide channel that receives the strap after encirclement of items to be bundled. The tang engages the rungs of the ladder strap for the adjustable retention of the items. The free end of the strap has a light-weight webbed tail that facilitates the insertion of the strap into the head. The strap is advantageously molded of a stretch reorientable material and is subsequently stretched to produce a suitable strengthening and elongation of the webbed tail.

Although well known and widely used in commerce, conventional cable ties have been found to be susceptible to tampering. Specifically, with the strap of the cable tie inserted into and through the elongated channel in the head to form a closed loop, the strap can be subsequently backed out from the head by inserting a thin object, such as a pin, into the elongated channel and maneuvering the thin object so as to deflect the flexible pawl out of engagement with the teeth on the strap. With the flexible pawl deflected out of engagement with the teeth on the strap, the closed loop of the cable tie can be opened, which is highly undesirable in certain applications.

SUMMARY OF THE INVENTION

It is an object of the present invention to provide a new and improved tie.

It is another object of the present invention to provide a new and improved tie which is particularly useful in securely pairing together two or more objects.

It is yet another object of the present invention to provide a tie as described above which is simple and inexpensive to manufacture.

It is still another object of the present invention to provide a tie as described above which is easy to use.

It is another object of the present invention to provide a tie as described above which is tamper-proof.

Accordingly, as one feature of the present invention, there is provided a tie for coupling together two or more objects comprising a cable tie shank comprising, a tail having a first end, a second end, a top surface and a plurality of teeth formed on the top surface, and an enlarged button end formed onto said tail, and a nut having an elongated opening and a pawl disposed to project into the elongated opening, the elongated opening being sized and shaped to permit the tail of said cable tie shank to be disposed therethrough, the pawl sequentially engaging the plurality of teeth when said tail is inserted into and through the elongated opening in said nut.

As another feature of the present invention, there is provided a tie for coupling together two or more objects comprising a cable tie shank having a tail, and a nut having a top surface, a bottom surface, an elongated opening and a pawl disposed to project into the elongated opening, the elongated opening being sized and shaped to permit the tail of said cable tie shank to be disposed therethrough, the pawl being disposed to engage the tail when the tail is inserted into and through the elongated opening in said nut wherein said nut is shaped to include a shroud for preventing tampering of the pawl.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings, wherein like reference numerals represent like parts.

DETAILED DESCRIPTION OF A PREFERRED EMBODIMENT

Figure 1:
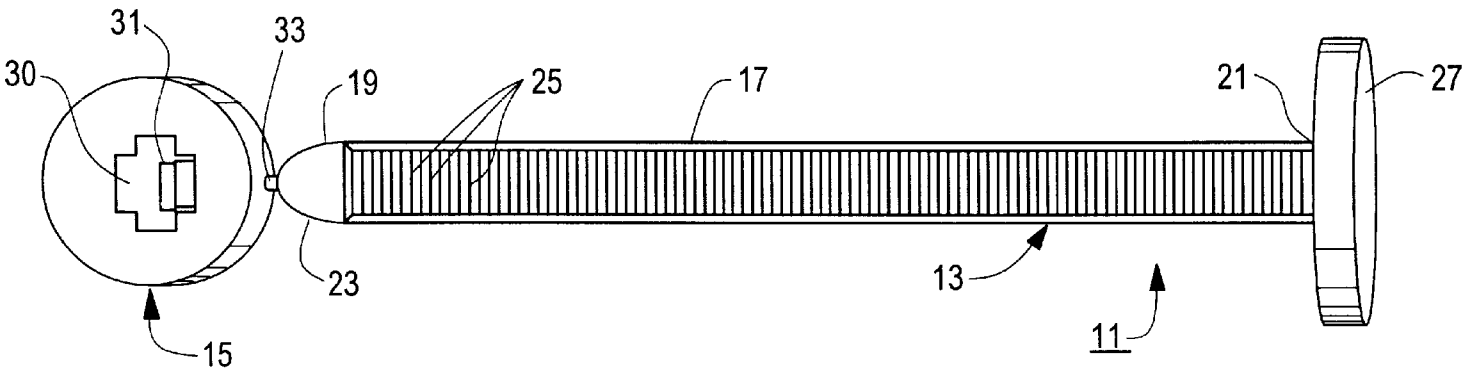
FIG. 1 is a top perspective view of a first embodiment of a rivet tie constructed according to the teachings of the present invention for coupling together two or more objects.

Referring now to FIG. 1, there is shown a first embodiment of a rivet tie constructed according to the teachings of the present invention for coupling together two ore more objects, the tie being represented generally by reference numeral 11. As will be discussed in detail below, tie 11 can be used in various applications to securely couple together two or more objects. As an example, tie 11 can be used to couple together a pair of socks. As another example, tie 11 can be used to couple together two or more sheets of paper. As another example, tie 11 can be used to couple a toy to a display box.

Rivet tie 11 is constructed preferably of plastic and comprises a cable tie shank 13 and a pawl nut 15.

Cable tie shank 13 comprises a tail 17 having a first end 19, a second end 21, a top surface 23 and a plurality of ratchet teeth 25 formed on top surface 23. Cable tie shank 13 further comprises an enlarged button end 27 which is integrally formed onto second end 21. Enlarged button end 27 is generally disc-shaped It should be noted that cable tie shank 13 is not limited to comprising plurality of ratchet teeth 25 on top surface 23. Rather, cable tie shank 13 could comprise alternative means for engaging a pawl, such as a ladder-type construction, without departing from the spirit of the present invention.

It should also be noted that button end 27 is not limited to having a disc shape. Rather, button end 27 could be alternatively shaped, such as box-shaped, without departing from the spirit of the present invention.

Pawl nut 15 is generally disc-shaped and comprises a top surface 28, a bottom surface 29 and an elongated central opening 30 which is sized and shaped to permit tail 17 to be disposed therethrough, as will be described further in detail below. Pawl nut 15 also comprises a flexible pawl 31 which is disposed to project partially into elongated central opening 30. As will be described further in detail below, flexible pawl 31 is disposed to sequentially engage plurality of ratchet teeth 25 on cable tie shank 13.

It should be noted that pawl nut 15 is not limited to comprising flexible pawl 31 for sequentially engaging plurality ratchet teeth 25. Rather, pawl nut 15 could comprise alternative means for sequentially engaging plurality of ratchet teeth 25, such as a fixed angular projection or a conventional locking tang designed to engage a ladder-type strap, without departing from the spirit of the present invention.

Rivet tie 11 is preferably constructed as an integral device with pawl nut 15 being affixed to first end 19 of cable tie shank 13 through a break-away attachment member 33 of limited strength. Due to the limited strength of break-away attachment member 35, pawl nut 15 can be easily separated from cable tie shank 13 through break-away attachment member 33, such as by pulling pawl nut 15 and cable tie shank 13 apart or by twisting pawl nut 15 relative cable tie shank 13.

Although rivet tie 11 is preferably constructed as an integral device, it is to be understood that rivet tie 11 could be constructed as a multi-piece device without departing from the spirit of the present invention. For example, cable tie shank 13 and pawl nut 15 of rivet tie 11 could be manufactured and sold as two separate pieces without departing from the spirit of the present invention.

Break-away attachment member 33 is preferably constructed of plastic and is of limited cross-sectional thickness. With cable tie shank 13, pawl nut 15 and break-away attachment member 33 all being constructed of plastic, rivet tie 11 can be manufactured through a single molding process using conventional molding techniques, thereby rendering rivet tie 11 simple and inexpensive to manufacture, which is an object of the present invention.

However, it is to be understood that break-away attachment member 33 is not limited to a plastic member of limited cross-sectional thickness. Rather, break-away attachment member 33 could be represented by alternative limited strength attachment means, such as an adhesive, without departing from the spirit of the present invention.

Rivet tie 11 can be used to couple together two or more objects. For simplicity purposes, in FIGS. 2 and 3, rivet tie 11 is shown being used to couple together a first object $O_1$, with a second object $O_2$. However, it is to be understood that rivet tie 11 could be used to couple together more than two objects without departing from the spirit of the present invention.

In use, rivet tie 11 can be used to couple together two or more objects in the following manner. First, pawl nut 15 is separated from cable tie shank 13 through break-away attachment member 33, such as by pulling pawl nut 15 and cable tie shank 13 apart and/or by twisting pawl nut 15 relative cable tie shank 13. Having separated pawl nut 15 from cable tie shank 13, first end 19 of cable tie shank 13 is disposed through first object $O_1$ and second object $O_2$ until first object $O_1$ abuts against enlarged button head 27. With first object $O_1$ and second object $O_2$ positioned as such, first end 19 of cable tie shank 13 is inserted into and through elongated central opening 30 in pawl nut 15 so that pawl 31 is in alignment with plurality of ratchet teeth 25. Mounted on cable tie shank 13, pawl nut 15 is advanced forward towards button head 27, as represented by arrow A in FIG. 2, by any suitable means, such as by hand or using a conventional cinching tool.

Figure 2:
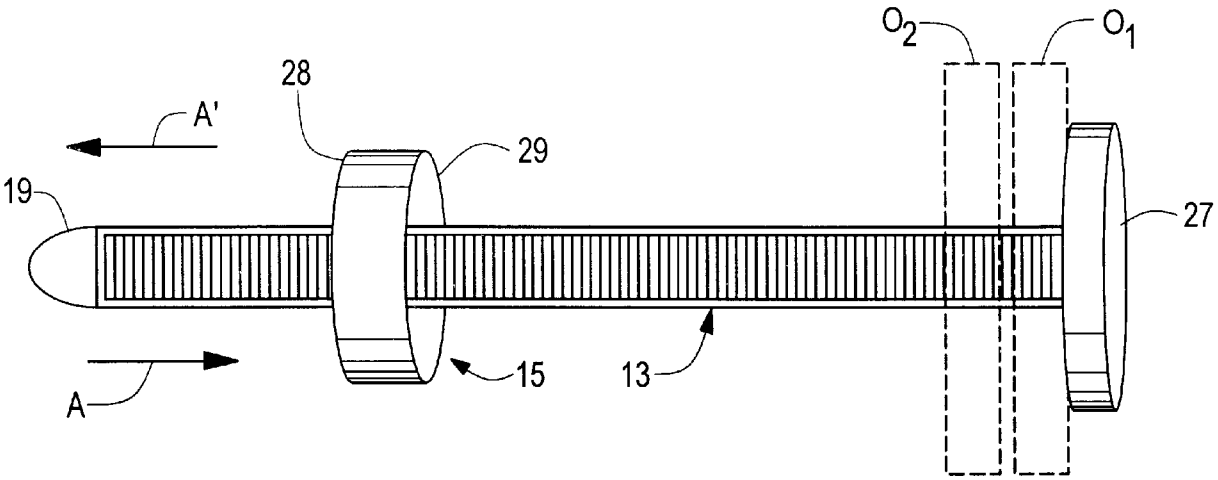
FIG. 2 is a top perspective view of the rivet tie shown in FIG. 1, the pawl nut being shown mounted on the cable tie shank for coupling together a pair of objects.

As pawl nut 15 is advanced forward towards button head 27, pawl 31 sequentially engages plurality of ratchet teeth 25 on shank 13 to prevent any rearward movement of pawl nut 15, as represented by arrow A' in FIG. 2. As can be appreciated, the engagement of pawl 31 on plurality of ratchet teeth 25 ensures that pawl nut 15 remains mounted on tail 17, thereby providing a secure coupling of first object $O_1$ with second object $O_2$, which is an object of the present invention.

Figure 3:
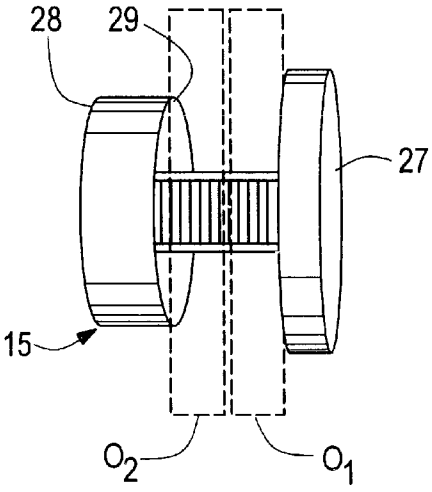
FIG. 3 is a top perspective view of the rivet tie shown in FIG. 1, the pawl nut being shown mounted on the cable tie shank for coupling together a pair of objects, the excess portion of cable tie shank being removed.

Pawl nut 15 is further advanced towards button head 27 until bottom surface 29 of pawl nut 15 abuts against second object $O_2$. The portion of tail 17 from top surface 28 of pawl nut 15 to first end 19 is considered waste and is preferably severed and discarded, as shown in FIG. 3.

Figure 4:
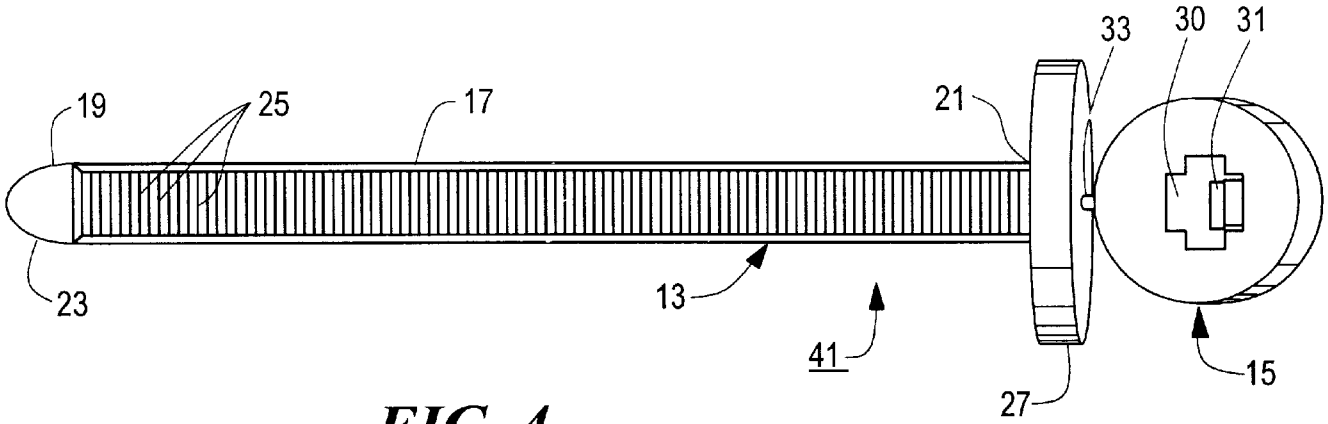
FIG. 4 is a top perspective view of a second embodiment of a rivet tie constructed according to the teachings of the present invention for coupling together two or more objects.

Referring now to FIG. 4, there is shown a second embodiment of a rivet tie constructed according to the teachings of the present invention for coupling together two or more objects, the tie being represented generally by reference numeral 41.

Rivet tie 41 differs from rivet tie 11 in the way in which pawl nut 15 is affixed to cable tie shank 13. Specifically, in rivet tie 11, pawl nut 15 is affixed to first end 19 of cable tie shank 13 by break-away attachment member 33. To the contrary, in rivet tie 41, pawl nut 15 is affixed to button end 27 of cable tie shank 13 by break-away attachment member 33.

As can be appreciated, affixing enlarged pawl nut 15 to enlarged button end 27 facilitates the molding process for manufacturing rivet tie 41 as one piece. In particular, it has been found that placing the two largest components of rivet tie 41 together, namely pawl nut 15 and button end 27, simplifies the process for molding rivet tie 41 as a single piece, which is highly desirable.

Figure 5:
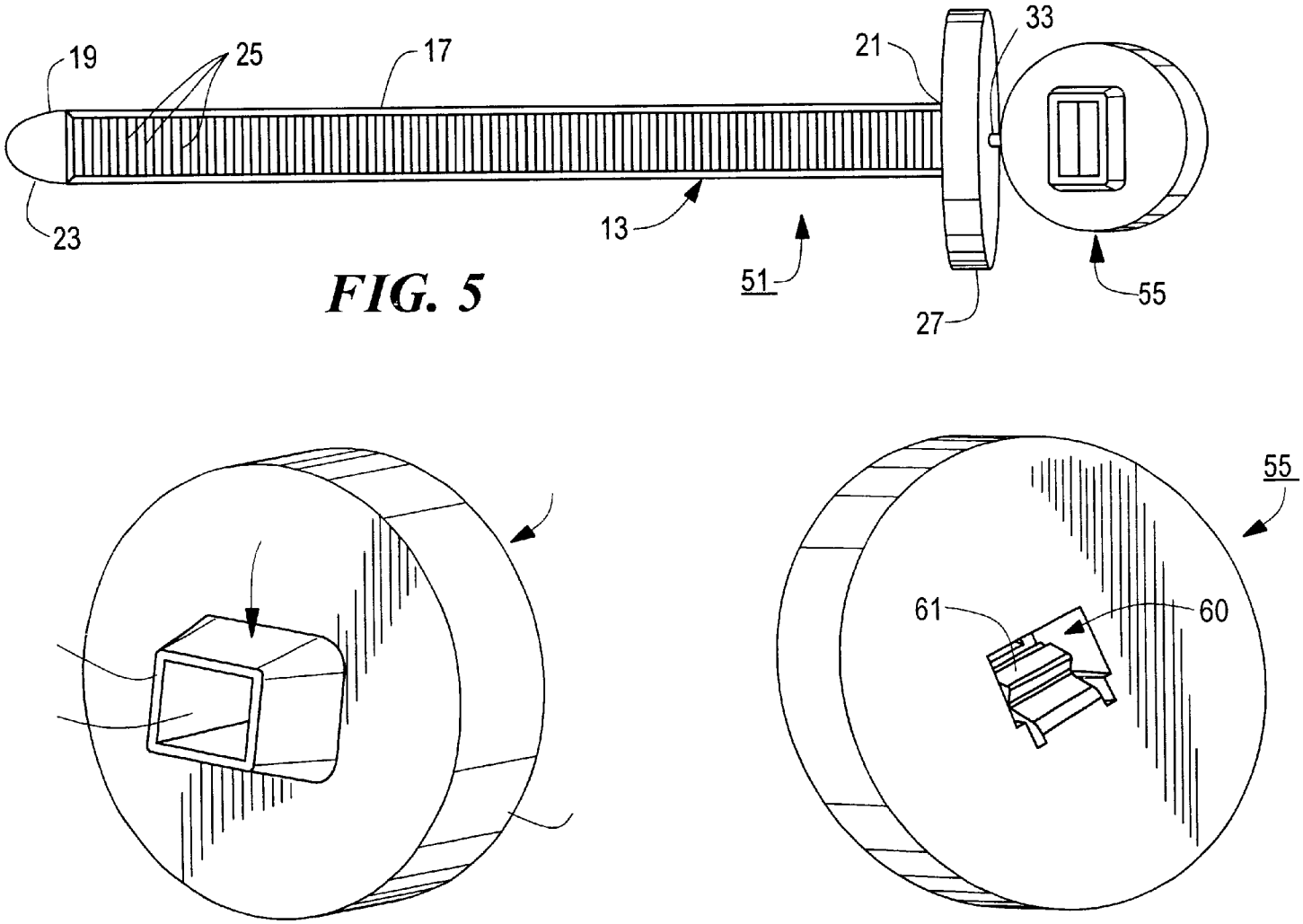
FIG. 5 is a top perspective view of a third embodiment of a rivet tie constructed according to the teachings of the present invention for coupling together two or more objects.
Figure 6:
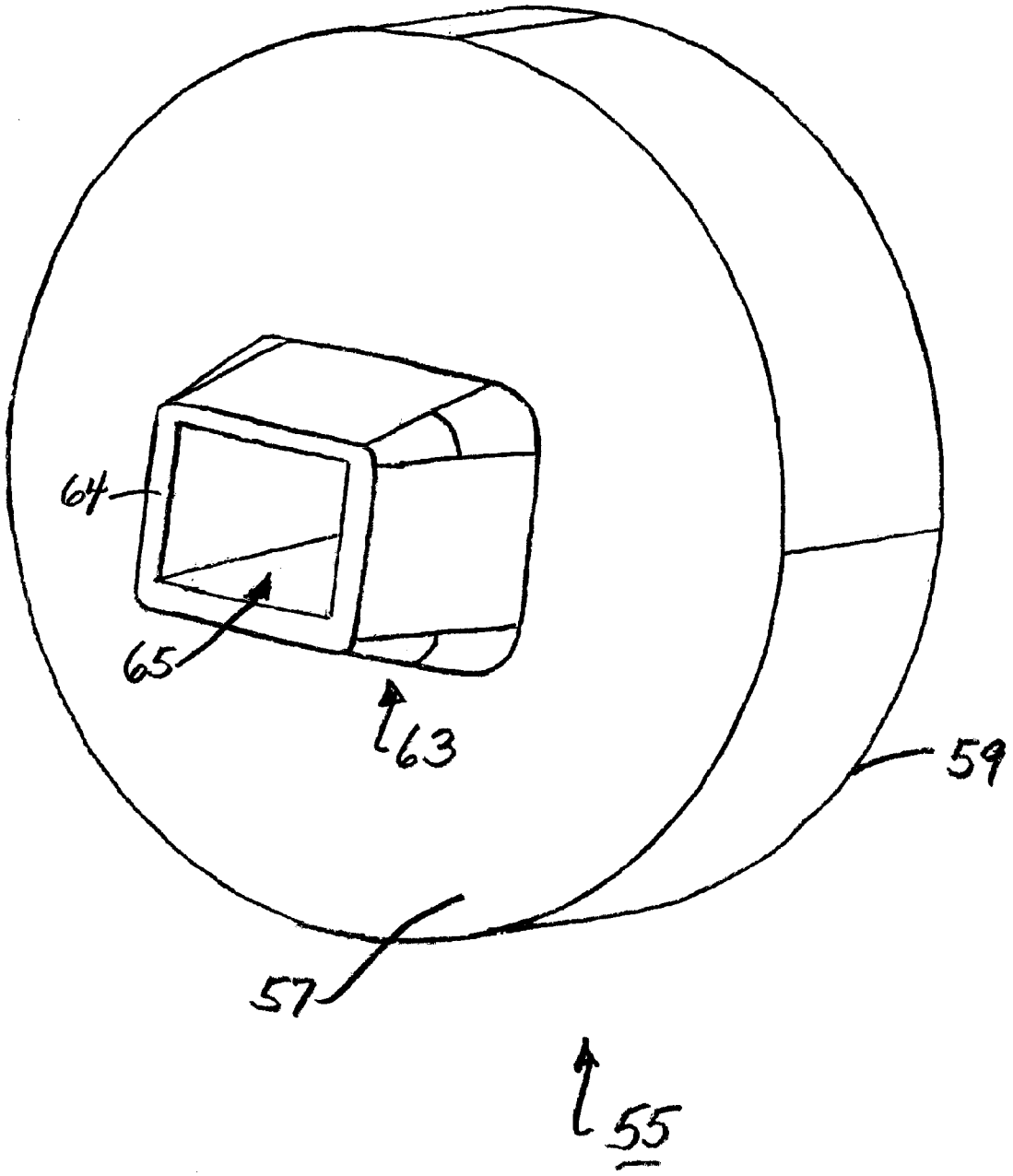
FIG. 6 is a top perspective view of the pawl nut shown in FIG. 5.
Figure 7:
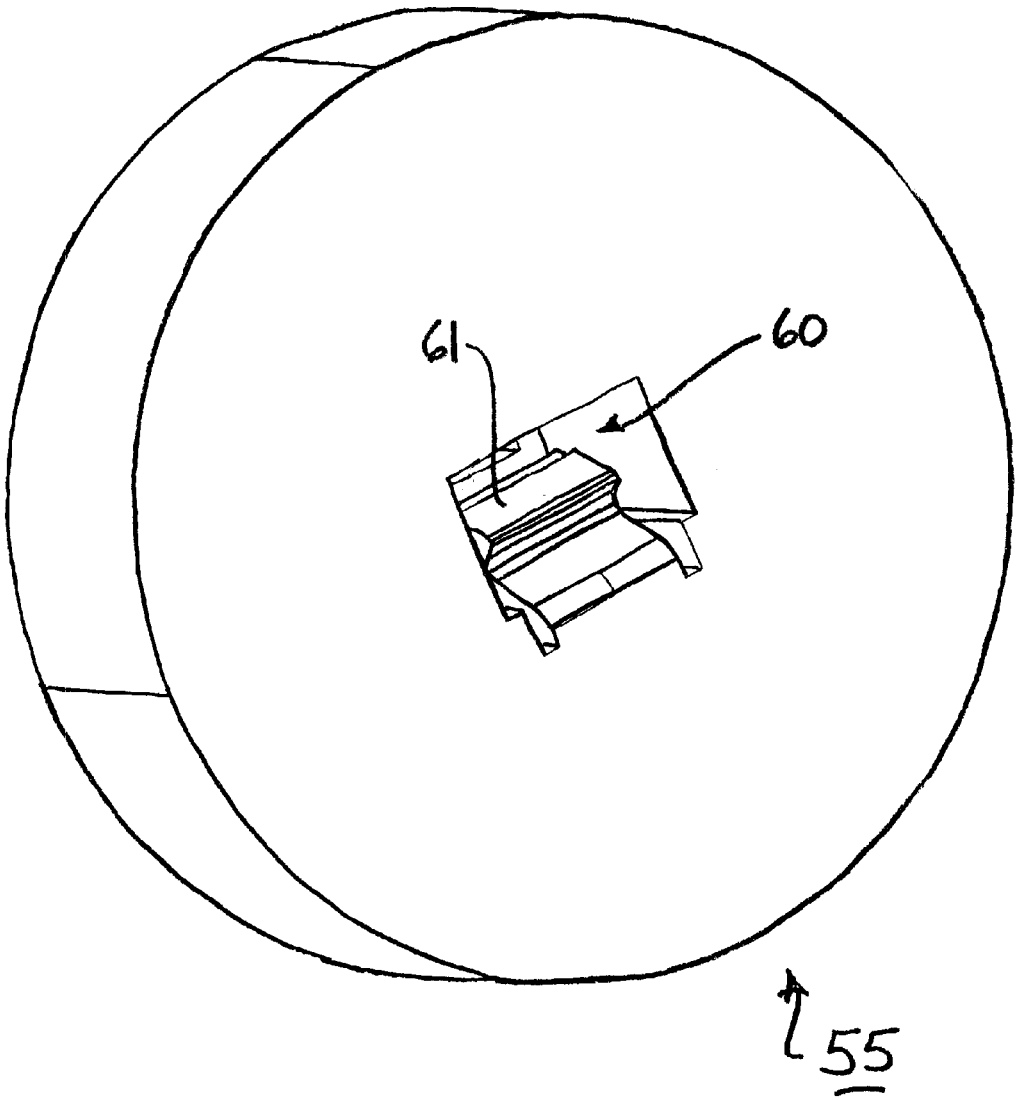
FIG. 7 is a bottom perspective view of the pawl nut shown in FIG. 5.

Referring now to FIGS. 5–7, there is shown a third embodiment of a rivet tie constructed according to the teachings of the present invention for coupling together two or more objects, the tie being represented generally by reference numeral 51.

Rivet tie 51 comprises cable tie shank 13 and a pawl nut 55. As will be described further in detail below, rivet tie 51 differs in construction from rivet tie 41 in that pawl nut 55 differs in construction from pawl nut 15.

Referring now to FIGS. 6 and 7, pawl nut 55 is generally disc-shaped and comprises a top surface 57, a bottom surface 59 and an elongated central opening 60 which is sized and shaped to permit tail 17 to be disposed therethrough. Pawl nut 55 also comprises a flexible pawl 61 which is disposed to project partially into elongated central opening 60. Flexible pawl 61 is disposed to sequentially engage plurality of ratchet teeth 25 when tail 17 is fed into and through pawl nut 55.

Pawl nut 55 differs from pawl nut 15 in that pawl nut 55 is shaped to include a shroud 63 for preventing tampering of flexible pawl 61. Shroud 63 is integrally formed onto top surface 57 over elongated central opening 60. Shroud 63 is shown having a tapered construction, shroud 63 having a reduced lateral cross-sectional area away from top surface 57. However, it is to be understood that shroud 63 not limited to having a tapered construction.

Shroud 63 includes an outer surface 64 and a tail receiving opening 65 in communication with elongated central opening 60. It should be noted that the lateral cross-section area of tail receiving opening 65 at outer surface 64 is only slightly larger than the lateral cross-section area of tail 17. As a result, with tail 17 is inserted into and through nut 55 and with second object $O_2$ in abutment against bottom surface 59, a thin tampering device is incapable of being inserted into nut 55 to tamper with the engagement of flexible pawl 61 on teeth 25, which is an object of the present invention.

It should be noted that shroud 63 is not limited to being integrally formed onto top surface 57. Rather, nut 55 could alternatively be constructed with shroud 63 being separate from the remainder of nut 55, shroud 63 being adapted to be fixedly mounted onto top surface 57 through an additional manufacturing step without departing from the spirit of the present invention.

It should also be noted that the implementation of shroud 63 is not limited to pawl nut 55. Rather, shroud 63 could additionally be formed onto the locking head of any conventional cable tie to prevent pawl tampering without departing from the spirit of the present invention.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A tie for coupling together two or more objects comprising:

a) a cable tie shank comprising,
   i) a tail having a first end, a second end, a top surface and a plurality of teeth formed on the top surface, and
   ii) an enlarged button end formed onto said tail, and b) a nut having an elongated opening and a pawl disposed to project into the elongated opening, the elongated opening being sized and shaped to permit the tail of said cable tie shank to be disposed therethrough, the pawl sequentially engaging the plurality of teeth when said tail is inserted into and through the elongated opening in said nut, c) wherein said nut is affixed to said cable tie through a break-away attachment member of reduced strength.

2. The tie as claimed in claim 1 wherein the plurality of teeth on said tail are ratchet shaped.

3. The tie as claimed in claim 2 wherein said enlarged button end is integrally formed onto the first end of said tail.

4. The tie as claimed in claim 3 wherein said enlarged button end is generally disc-shaped.

5. The tie as claimed in claim 1 wherein said tie is manufactured as a single piece.

6. The tie as claimed in claim 5 wherein said tie is manufactured as one piece using conventional molding techniques.

7. The tie as claimed in claim 1 wherein said nut is affixed to the first end of the tail of said cable tie shank.

8. The tie as claimed in claim 1 wherein said nut is affixed to the enlarged button end of said cable tie shank.

9. The tie as claimed in claim 1 wherein said nut is shaped to include a shroud for preventing tampering of the pawl.

10. The tie as claimed in claim 9 wherein said shroud is formed on the top surface of said nut over the elongated opening.

11. The tie as claimed in claim 10 wherein said shroud includes a outer surface and a tail receiving opening in communication with the elongated opening.

12. The tie as claimed in claim 11 wherein the cross-sectional area of the strap accepting channel at the top surface of said shroud is slightly larger than the cross-sectional area of said tail.

13. The tie as claimed in claim 12 wherein said shroud is tapered.

* * * * *